United States Patent [19]

Keller

[11] Patent Number: 4,949,427

[45] Date of Patent: Aug. 21, 1990

[54] HINGE WITH INTEGRAL DETENT AND STOP

[76] Inventor: Russell D. Keller, 149 N. Lotus Beach Dr., Portland, Oreg. 97217

[21] Appl. No.: 293,953

[22] Filed: Jan. 6, 1989

[51] Int. Cl.[5] ..... E05D 11/10; E05D 11/06

[52] U.S. Cl. ..... 16/335; 16/377

[58] Field of Search ..... 16/332, 296, 297, 327, 16/286, 278, 377, 335

[56] References Cited

U.S. PATENT DOCUMENTS

| | | | |
|---|---|---|---|
| 1,019,068 | 3/1912 | McKinnon | 16/335 |
| 2,181,025 | 11/1939 | Plotkin | 16/82 |
| 2,799,042 | 7/1957 | Hollansworth | 16/335 |
| 3,911,529 | 10/1975 | Pringle | 16/335 |
| 4,800,624 | 1/1989 | Whitefoot et al. | 16/335 |

*Primary Examiner*—Richard K. Seidel

*Assistant Examiner*—Carmine Cuda

*Attorney, Agent, or Firm*—Klarquist, Sparkman, Campbell, Leigh & Whinston

[57] ABSTRACT

This invention relates to a vehicle door hinge which has an integral detent and stop. A spring having a flat surface portion and an arcuate surface portion is attached to a first hinge member with the arcuate portion of the spring curved about the axis of the hinge. A roller restrained on a second hinge member is in compressive contact with the arcuate portion of the spring. A depression across the arcuate portion of the spring, works in conjunction with the roller as a detent to produce an intermediate stop position. The arcuate portion of the spring has an end portion, wider than the remainder of the spring, which contacts the second hinge member to provide a stop which prevents further opening rotation of the hinge.

18 Claims, 3 Drawing Sheets

HINGE WITH INTEGRAL DETENT AND STOP

TECHNICAL FIELD

This invention relates to hinges for attaching doors to door openings, and specifically to vehicle door hinges. The hinge has an intermediate stop or detent and a full open stop integral with the hinge assembly.

BACKGROUND OF THE INVENTION

Most vehicle door hinges are single pivot hinges. That is, a pivot pin holds two cooperating members in rotational relationship such that one hinge member may rotate in respect to another hinge member about a common axis. The first hinge member is attached to the cowl side or body of the vehicle while the second hinge member is attached to the door of the vehicle. Usually two hinges are used for each door, the first hinge member of the first hinge being mounted high on the body cowl side while the second hinge member of the first hinge is mounted high on the door of the vehicle, and the first hinge member of the second hinge being mounted low on the body cowl side while the second hinge member of the second hinge is mounted low on the door of the vehicle. The axis of the hinge pins are usually aligned along a common axis.

It is necessary to provide a full open stop for the door. Unrestrained motion beyond the design limits of rotational travel of the door can cause the outer surface of the door to strike and damage body members such as fenders or cowl sides. These stops are often separate members attached to the door and the vehicle body which requires additional man hours to mount this hardware and additional reinforcements of the vehicle door and/or body. A stop integral with the hinge would be advantageous.

Intermediate stops or detents for a vehicle door hinge are also desireable. This intermediate stop position allows the door to remain partially open in a fixed position. This intermediate stop position could still allow for ingress and egress in cramped or restricted areas. The detent or intermediate stop can prevent inadvertent unrestrained motion of the door from putting a high shock or impact load against the full open stop.

SUMMARY OF THE INVENTION

It is therefore an object of this invention to provide a hinge with an integral detent and stop.

A specific object is to provide such a hinge for attaching a vehicle door to a vehicle body.

It is a further object of this invention to provide a hinge wherein the stop and detent positions can be incorporated in a single piece to allow a group of hinges to be produced with various detent and stop positions by only changing one part.

It is also an object of this invention to devise a hinge which has a minimum number of components and which is simple to manufacture and assemble.

The hinge of the present invention includes a first hinge member for attachment to a vehicle body and a second hinge member for attachment to a vehicle door interconnected by a hinge pin which permits the hinge members to rotate about a common axis.

A leaf spring is restrained against the first hinge member. The leaf spring includes a flat surface portion and a substantially semicircular arcuate surface portion. The arcuate surface portion of the spring lies about the pivot axis of the hinge members through an opening in the second hinge member. The arcuate surface portion of the spring has an end portion or nose which is wider than the remainder of the spring and which is also wider than the opening in the second hinge member. The end portion of the arcuate surface portion of the spring is contacted by the second hinge member at the full open position of the door and functions as a stop. The arcuate surface portion of the spring is disturbed by a depression across the spring surface. The depression is on the arcuate surface portion of the spring between the nose portion and the flat surface portion. A roller is restrained against the second hinge member in the area of the opening in the second hinge member. The roller is in rolling compressive contact with the spring. As the second hinge member is rotated about the pivot pin, the roller rolls along the arcuate surface portion of the spring. At the area of the depression in the spring, the roller engages the depression to effect a detent. The detent holds the vehicle door in an intermediate open position. A force must be applied to the vehicle door to allow the roller to roll up and out of the depression and to continue to roll about the remainder of the arcuate portion of the spring.

Other objects and advantages of the present invention will be apparent from the following description of a preferred embodiment thereof and from the attached drawings.

DETAILED DESCRIPTION OF PREFERRED EMBODIMENT

Figure 1:
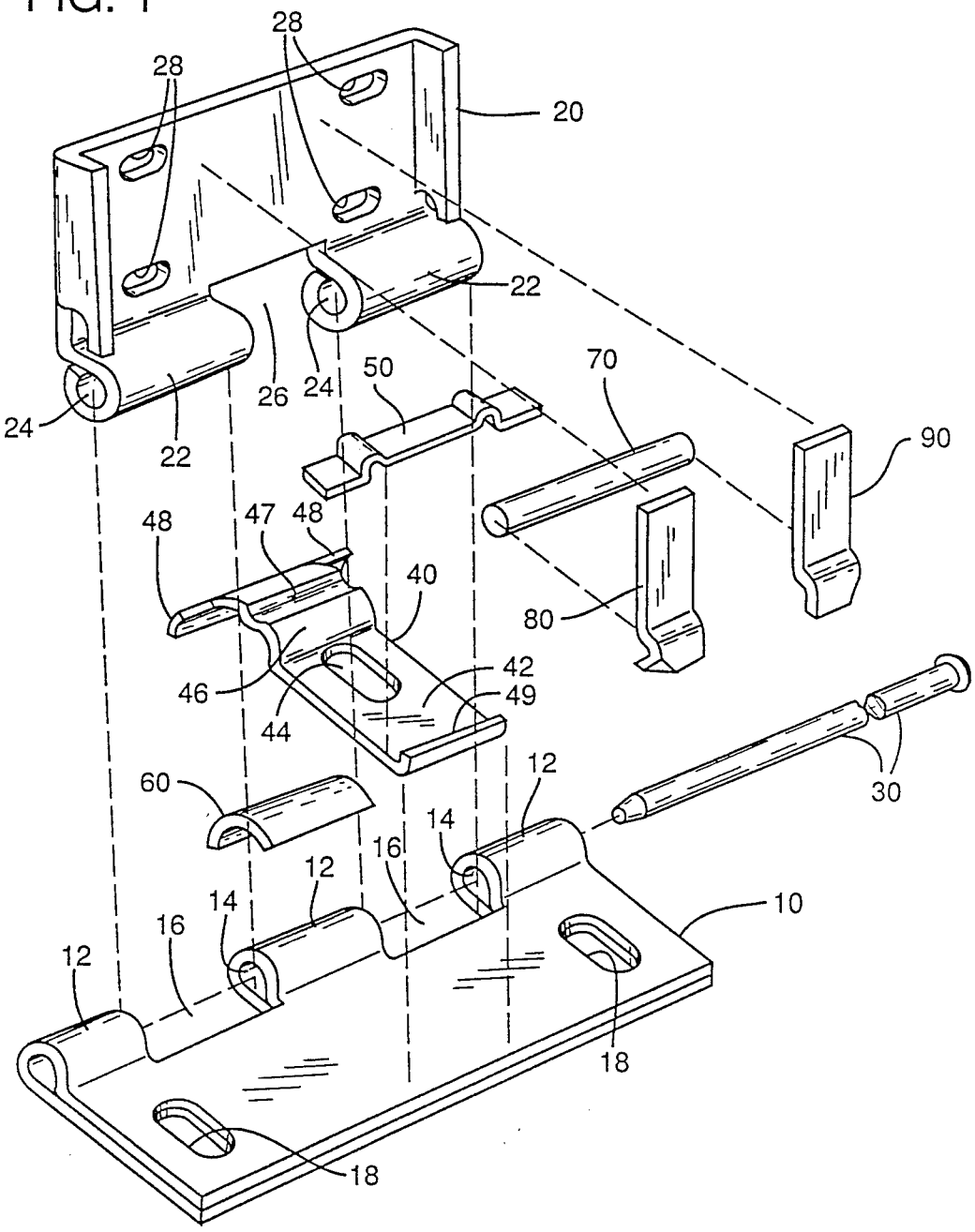
FIG. 1 is an exploded view of the hinge showing all of the components thereof.

The hinge assembly of the present invention is of simple construction, easy to manufacture and economical to produce with an integral detent and stop. Referring to FIG. 1, a preferred embodiment of the hinge assembly consists of a first hinge member 10. The first hinge member is formed of a folded metal plate having a radius outer edge 12 at the fold. The interior of the outer edge circumscribes a substantially circular opening 14 running the length of the first hinge member. Cutout portions 16 are provided along the length to interconnect with a second hinge member 20 as will be discussed below. Provisions for mounting the first hinge member to a vehicle cowl side or body, such as slotted bolt openings 18, are provided. The second hinge member 20 is also formed of metal. The second hinge member has a substantially circular formed portion 22 at one end. This circular formed portion circumscribes a generally circular opening 24 of approximately the same diameter as circular opening 14 of the first hinge member. The formed metal portion 22 is disrupted along its length by a cutout 26. The second hinge member also has provisions for mounting to a vehicle door such as bolt slots 28. The various circular formed members of each component are so designed such that the first hinge member may nest with the second hinge member such that circular openings 14 and circular openings 24 are coaxial. A hinge pin 30 may then be inserted into circular opening 14 through circular opening 24 to interlock the two hinge members in rotational relationship to one another about a common axis. The hinge pin 30 may be staked, headed or provided with a clip to prevent it from being disassembled from the hinge members after assembly. Similarly, circular openings 14 and 24 may be sized such that bushings or bearings (not shown) may be inserted. This would provide a lower friction rotating surface for the first hinge member to rotate about the hinge pin in respect to the second hinge member.

A leaf spring 40 is provided for the door hinge. The spring has a flat surface portion 42. Centrally located within the flat surface portion is a slot 44. The function of the slot will be explained below. Integrated with the flat surface portion of the spring is an arcuate surface portion 46. This arcuate surface portion subscribes generally a semi-circular arc. This arcuate surface portion is disturbed by a depression 47 extending cross its width. The termination of the arcuate surface portion is an end portion or nose 48 which is wider than a remainder of the arcuate portion of the spring. The other end of the spring opposite the nose portion has a turned up tab 49. A metal strap 50 is positioned over the flat portion 42 of the spring and is welded to the first hinge member 10 to restrain the spring against the first hinge member. The arcuate portion of the spring surrounds the circular formed section 12 of the first hinge member. The spring element 40 cannot escape because the tab 49 would engage the strap 50 and prevent the spring from being forced out of position. The slot 44 in the spring member allows a controlled deflection rate of the spring. The thinnest section of the spring is across the flat surface portion in the area of the slot. The wider the slot, the less spring material present and therefore the lower the deflection rate of the spring. The narrower the slot 44, the more spring material, therefore the greater the deflection rate of the spring. This method of supporting the spring and the use of slot 44 allows the major portion of the deflection of the spring to be in the flat surface portion of the spring, and prevents undue stresses to be built up in any of the curved or arcuate portion of the spring member. Because the arcuate portion of the spring member could contact the curved circular portion 12 of the first hinge member, a compressible element 60 is placed between them. The compressible element 60 can be a synthetic polymer, a synthetic rubber, natural rubber, or any other elastomer material. The purpose of this element is to prevent squeaking and noise from metal to metal contact of the spring element 40 against the first hinge member 10. The spring assembly therefore, consists of the spring 40, the hold down strap 50 and the compressive member 60.

A roller assembly consisting of a metal roller 70, a first clip 80 and a second clip 90 is associated with second hinge member 20. Clips 80 and 90 are welded to the second hinge member 20 and engage the opposite ends of the roller, restraining the roller 70 against the second hinge member 20 in the area of the recess cutout or opening 26. In a preferred embodiment the diameter of roller 20 is at least twice the depth of depression 47.

Figure 2:
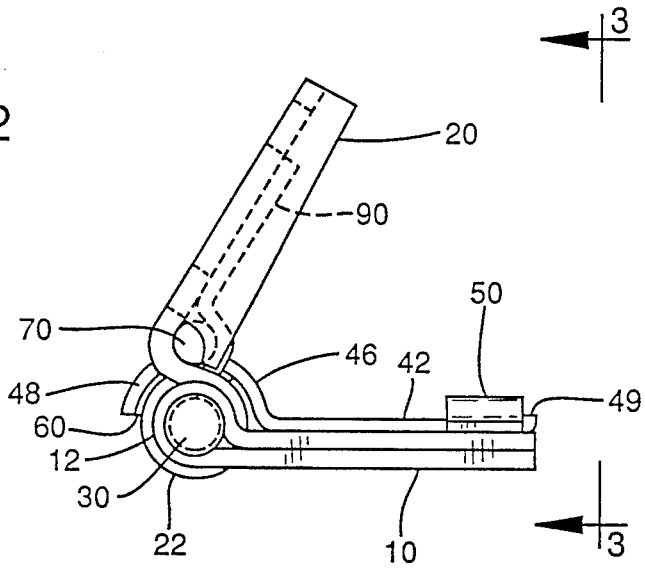
FIG. 2 is a top plan view of the hinge assembly.
Figure 3:
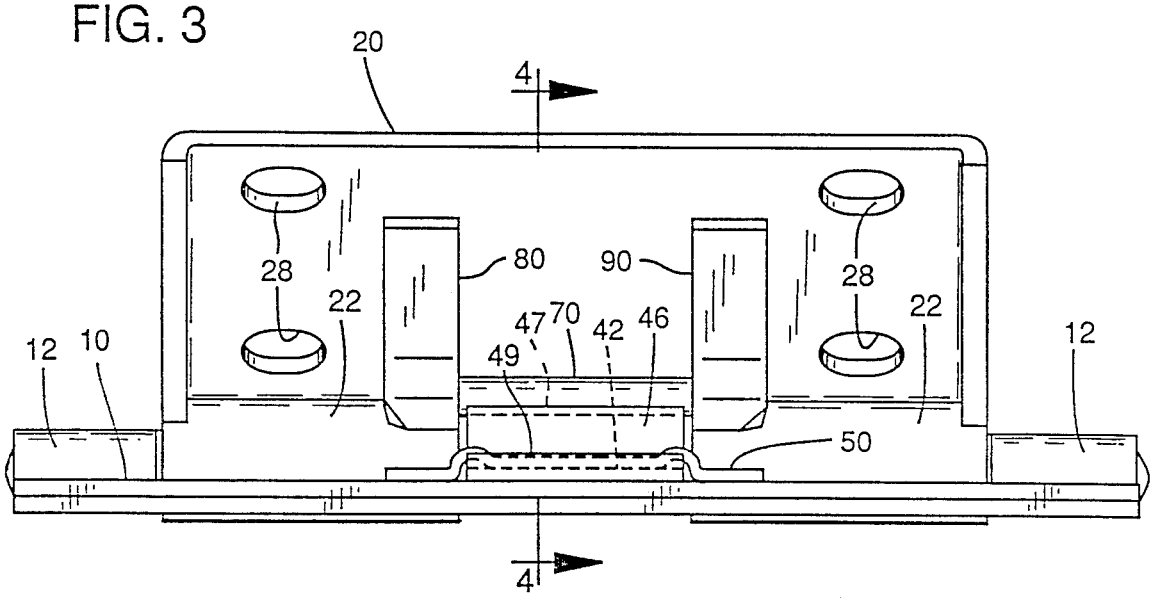
FIG. 3 is a side elevation view along the plane of arrows 3—3 of FIG. 2.

Referring now to FIGS. 2 and 3, the hinge assembly is shown assembled and in a partially open position with all of the components in the proper relationship.

Figure 4A:
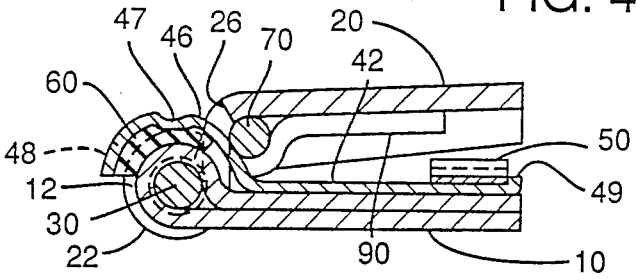
FIG. 4A is a horizontal section view of the hinge along the lines 4—4 of FIG. 3, with the hinge in a fully closed position.
Figure 4B:
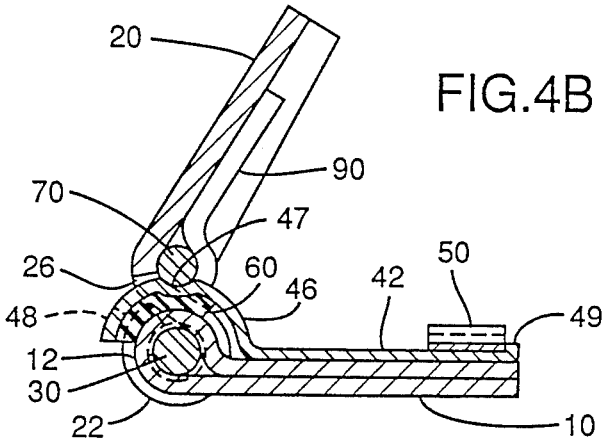
FIG. 4B is a horizontal section view of the hinge assembly similar to FIG. 4A, but in the detent or intermediate open position.
Figure 4C:
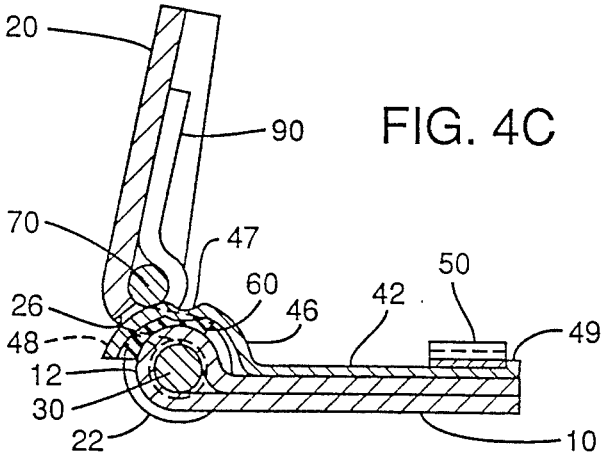
FIG. 4C is a horizontal section view of the hinge assembly similar to FIG. 4A, but in a fully open or full open stop position.

The operation of the hinge assembly can best be explained by referring to FIGS. 4A, 4B and 4C. FIG. 4A is a cross section of the hinge assembly with the hinge assembly in a fully closed position. It will be noted that roller 70 is on the start of the arcuate surface portion 46 of the spring. The compressive member 60 lies between the spring member 40 and the first hinge member 10. As the second hinge member is rotated in counter clockwise relationship to the first hinge member, about pivot pin 30, the roller 70 rolls up along the arcuate surface portion 46 of the spring until in FIG. 4B it reaches the depression 47 in the arcuate surface portion of the spring. At FIG. 4B, the spring and the compressive member have been compressed between the hinge member 10 and the roller 70, and the roller is resting in the depression 47 to serve as a detent or intermediate stop. This holds the vehicle door in a partially opened position. A force is required to be exerted on the door and hence, on second hinge member 20 to either return the hinge to the closed position shown in FIG. 4A or to continue the rotation of the hinge to the fully open position shown in FIG. 4C. In FIG. 4C, the edge of the second hinge member 20 can be seen to be in contact with enlarged end portion 48 of the spring assembly. Further rotation cannot occur as this is a line to line contact. It should be noted that the arcuate portion 46 of the spring can be produced such that it continues about its center of curvature for a greater arc distance, thus allowing an open position further than the approximate 90° position shown in FIG. 4C. Depression 47 also may be at any intermediate position along the arcuate portion of spring 40, thus setting the intermediate open or detent position of the hinge.

It should be noted that although one preferred embodiment of the invention has been shown and described, it will be obvious to one skilled in the art that modifications to the above disclosure can be made without deviating from the scope of the invention as described in the appended claims.

I claim:

1. A hinge assembly comprising:

a first hinge member and a second hinge member joined to rotate about an axis from a fully closed position to a fully open position;

spring means attached to said first hinge member for resiliently biasing the hinge assembly, said spring means being a leaf spring having a first substantially flat surface portion and a second arcuate surface portion, the arcuate surface portion having a depression across the surface thereof and an end portion wider than the remainder of the spring;

a roller restrained against the second hinge member and cooperating with the spring means to provide a detent means for halting rotation of the first hinge member with respect to the second hinge member at an intermediate position between the fully closed position and the fully open position; and the spring means cooperating with the second hinge member to stop rotation of the second hinge member with respect to the first hinge member at the fully open position.

2. A hinge assembly in accordance with claim 1 in which the flat surface portion has a slot centrally located therein to induce substantially all of the deflection of the spring in the flat portion.

3. A hinge assembly as recited in claim 2 wherein the radius of the arcuate surface portion of the spring is greater than the radius of the first hinge member about the axis of rotation.

4. A hinge assembly as recited in claim 1 wherein the spring is held against the first hinge member by a strap affixed to the first hinge member.

5. A hinge assembly in accordance with claim 1 in which the depth of the depression is less than one-half the diameter of the roller.

6. A hinge assembly as recited in claim 1 wherein the roller is restrained on the second hinge member by clips affixed to the second hinge member.

7. A vehicle door hinge assembly comprising:

a first hinge member adapted to be mounted to a first surface;

a second hinge member adapted to be mounted to a second surface;

a pivot pin interlocking the first hinge member and the second hinge member;

a spring having a first substantially flat surface portion and a second arcuate surface portion, the arcuate surface portion having a depression across the surface thereof and an end portion wider than the remainder of the spring;

a means to affix the spring to the first hinge member;

a roller restrained on the second hinge member and resting in contacting compressive relationship with the spring to roll about the arcuate surface portion of the spring during rotational movement of the first hinge member and the second hinge member about the pivot pin;

the roller entering the depression in the arcuate surface portion of the spring to restrain the hinge in an intermediate open position; and said end portion of the spring contacting the second hinge member to stop the rotational travel of the hinge.

8. The hinge assembly as recited in claim 7 wherein the radius of the arcuate surface portion of the spring is greater than the radius of the first hinge member about the axis of rotation.

9. The hinge assembly as recited in claim 7 wherein the depth of the depression in the arcuate surface portion of the spring is less than one half the diameter of the roller.

10. The hinge assembly as recited in claim 7 wherein the means to affix the spring is a strap across the spring welded to the first hinge member.

11. The hinge assembly as recited in claim 7 wherein the roller is restrained on the second member by clips welded to the second hinge member.

12. The hinge assembly as recited in claim 7 wherein a compressive member is placed between the arcuate surface portion of the spring and the first hinge member.

13. The hinge assembly as recited in claim 7 wherein the flat surface portion of the spring has a slot centrally located therein to induce substantially all deflection of the spring to occur within the flat surface portion thereof.

14. A vehicle door hinge assembly with an integral detent and stop comprising:

a first hinge member adapted to be mounted on a vehicle body;

a second hinge member adapted to be mounted on a vehicle door;

a pivot means to interlock the first hinge member to the second hinge member to allow rotation therebetween;

a spring;

a roller for cooperating with the spring;

a means to entrap the spring against the first hinge member;

the spring having a substantially flat surface portion to rest against the surface of the first hinge member, with a slot centrally located therein to induce most of the deflection of the spring in the flat surface portion, and an arcuate surface portion adapted to fit about the pivot means between the first hinge member and the second hinge member, the arcuate surface portion having a depression across the surface thereof and an end portion being wider than the remainder of the arcuate surface portion;

a means to restrain the roller against the second hinge member such that the roller is in rolling contact with the arcuate surface portion of the spring; and the roller cooperating with the spring such that partial rotation of the second hinge member about the first hinge member causes the roller to roll along the arcuate surface portion of the spring and engage the depression to form a detent to stop the unrestrained rotation of said second hinge member, but allowing continuing rotation of said second hinge member when a force is applied to the vehicle door until said end portion of the arcuate surface portion of the spring contacts the second hinge member stopping rotation of the hinge.

15. The hinge assembly as recited in claim 14 wherein the radius of the arcuate surface portion of the spring is greater than the radius of the first hinge member about the axis of rotation.

16. The hinge assembly as recited in claim 14 wherein the depth of the depression in the arcuate surface portion of the spring is less than one half the diameter of the roller.

17. A hinge assembly as recited in claim 14 wherein the means to entrap the spring against the first hinge member is a strap welded to the first hinge member.

18. A hinge assembly as recited in claim 14 wherein the means to restrain the roller against the second hinge member are clips welded to the second hinge member.

* * * * *